US006279629B1

(12) United States Patent
Sing

(10) Patent No.: US 6,279,629 B1
(45) Date of Patent: Aug. 28, 2001

(54) METHOD FOR MORE EFFICIENT USE OF SMALLER DIAMETER TREES

(76) Inventor: Peter Sing, P.O. Box 323, E. Olympia, WA (US) 98540

( * ) Notice: Subject to any disclaimer, the term of this patent is extended or adjusted under 35 U.S.C. 154(b) by 0 days.

(21) Appl. No.: 09/702,273

(22) Filed: Oct. 31, 2000

Related U.S. Application Data

(63) Continuation-in-part of application No. 09/396,712, filed on Sep. 13, 1999, now abandoned.

(51) Int. Cl.[7] ..... B27D 1/00; B27B 1/00; B27F 1/00

(52) U.S. Cl. ..... 144/347; 144/91; 144/329; 144/330; 144/335; 144/346; 144/352; 144/367; 156/304.1; 156/304.5; 52/730.7

(58) Field of Search ..... 52/233, 730.7, 52/731.2; 144/90.1, 91, 3.1, 2.1, 329, 330, 335, 344, 345, 346, 347, 352, 367; 156/304.1, 304.5; 426/106, 114, 116, 172

(56) References Cited

U.S. PATENT DOCUMENTS 4,624,295 * 11/1986 Howland ..... 144/347
5,896,723 * 4/1999 Jing ..... 52/730.7
6,025,053 * 2/2000 Grenier ..... 144/347

* cited by examiner

*Primary Examiner*—W. Donald Bray
(74) *Attorney, Agent, or Firm*—Robert W. Jenny

(57) ABSTRACT

The subject basic method and its modifications are used to provide logs reconstituted from smaller diameter trees up to 12 inches diameter at their bases. The basic method is practiced using the following steps:

1. Cutting felled trees at cutting points into a plurality of segments which, naturally, are tapered, each segment having a length, a larger diameter end and a smaller diameter end, the length being in a range of random lengths such that the larger end diameter is in a range of 0.2 to 2.0 inches larger than the smaller end diameter, with 0.2 inch preferred;
2. selecting from the plurality of segments cut from one or more trees, a plurality of groups of segments which have smaller end diameters no more than ½ inch different;
3. joining segments from each group end-to-end to form reconstituted logs of optimum lengths for processing into wooden structural units.

In one modification of the basic method, flawed portions are removed from the logs prior to cutting them into segments. In a second modification the individual segments are processed into wooden structural units which can be joined end-to-end to provide longer units. A third modification incorporates both the removal of flawed portions and the processing of the segments as stated for the second modification.

The subject method reduces wastage by as much as 80%.

4 Claims, 2 Drawing Sheets

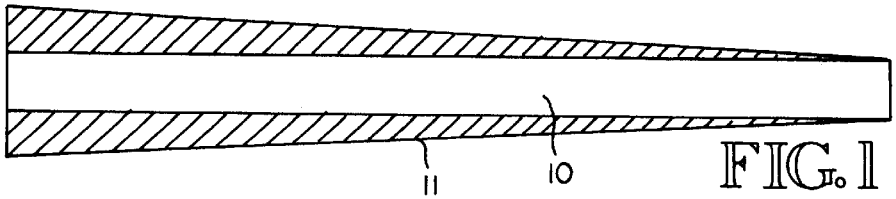
FIG. 1
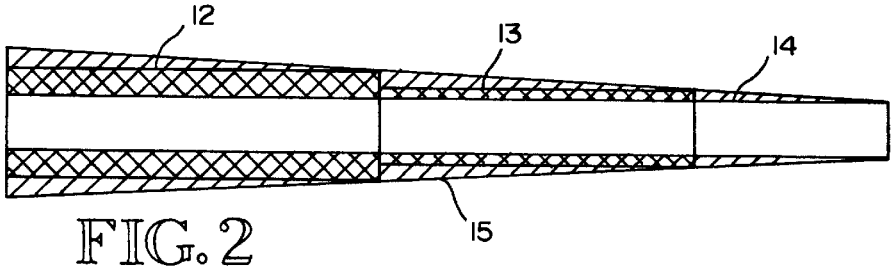
FIG. 2
FIG. 3A
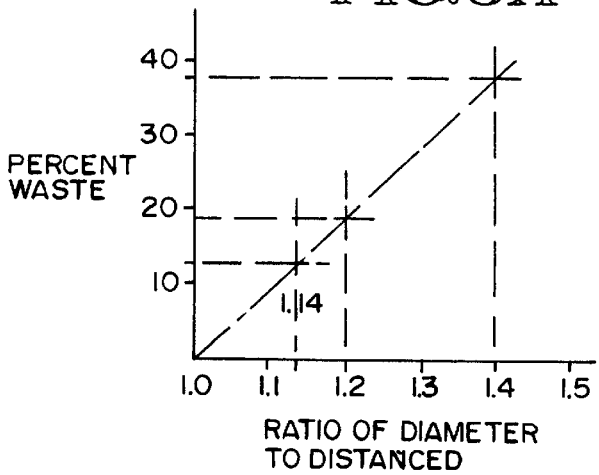
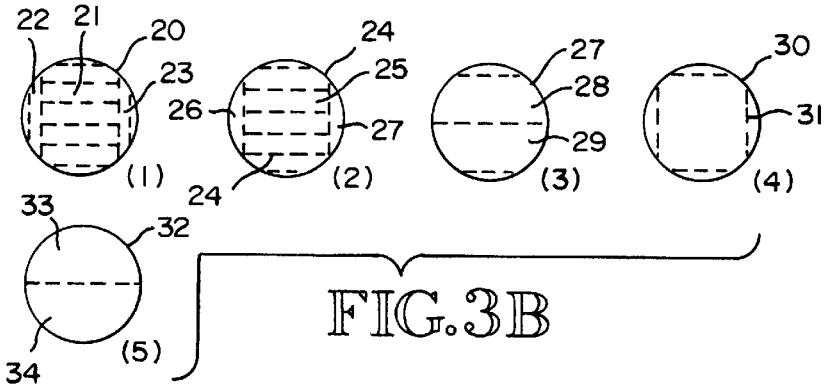
FIG. 3B
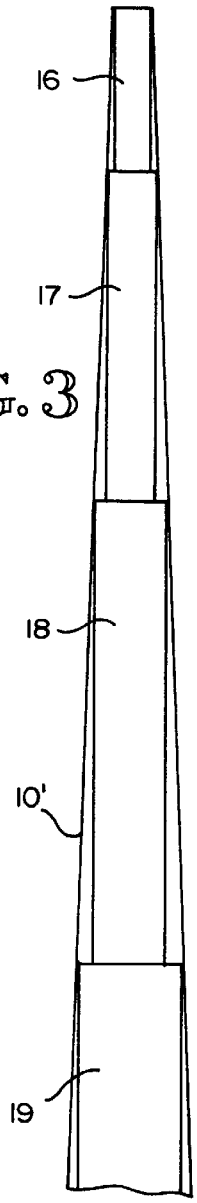
FIG. 3

FIG. 4
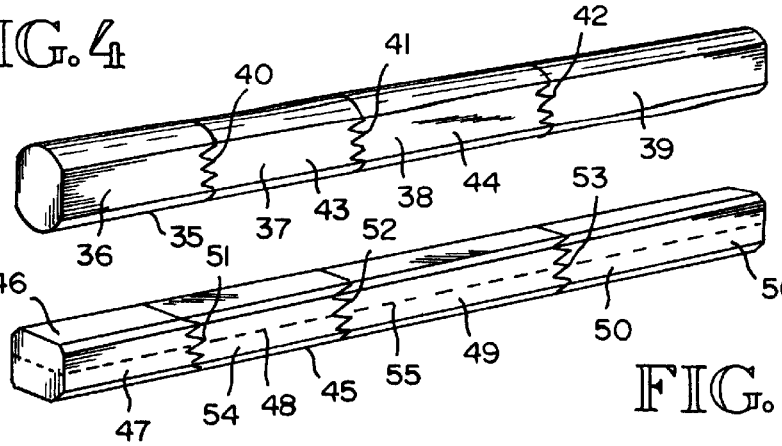
FIG. 5
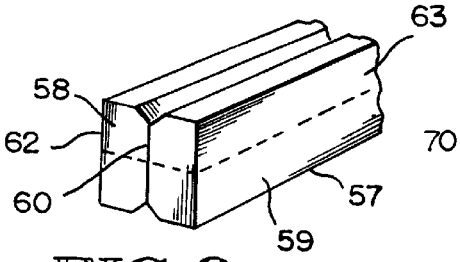
FIG. 6
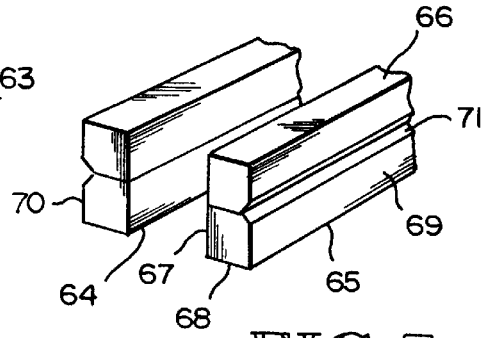
FIG. 7
FIG. 8
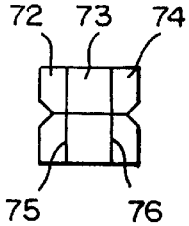
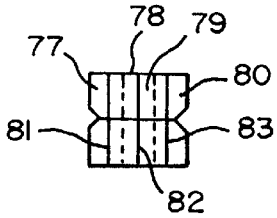
FIG. 9
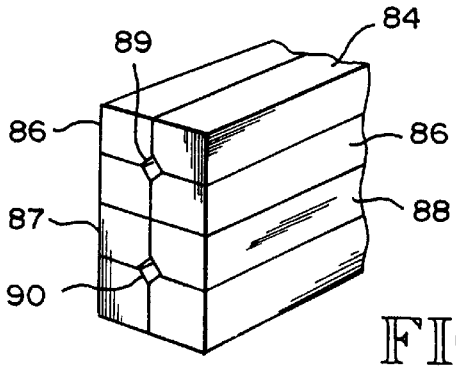
FIG. 10

METHOD FOR MORE EFFICIENT USE OF SMALLER DIAMETER TREES

This application is a Continuation-In-Part application based on application Ser. No. 09/396,712, filed Sep. 13, 1999, to be abandoned when this application is duly filed.

BACKGROUND OF THE INVENTION

FIELD: The subject invention is in the field of harvesting and milling trees, particularly the smaller diameter trees such as those harvested in the process of thinning trees on tree farms. The supply of wood is diminishing while the need for it is increasing and therefore it has become economically feasible and more important to use the smaller trees and to use them as efficiently as possible in terms of using as much of the tree as feasible while improving the quality of the end product called lumber.

In conventional milling of the smaller diameter trees, the trunks are cut into logs having lengths of 8, 10, 12, 16, 20 and 24 feet, depending on the diameters of the tapered trunks at their bases. The logs are then sawed to produce rough sawn lumber and there is considerable wastage, particularly when the end product is geometrically perfect rough sawn lumber. Significant reduction of wastage and end product improvement are achieved using techniques disclosed in U.S. Pat. No. 5,896,723, issued to the inventor of the subject invention. These techniques involve sawing the logs so that they have two parallel flat sides or a basically rectangular or square cross section shape with radiused corners called wanes. These logs are then sawn in half lengthwise and the halves reassembled with the outer surfaces that are parallel to the saw-cut glued together. The reassembled logs are then sawed in half lengthwise again with the cut perpendicular to the outer surfaces, yielding two boards flat on three sides and having an indentation in the center of the fourth side. This product has high quality because the wood originally at the center of the log is at its exterior where its superior strength is most effective. Also, U.S. Pat. No. 5,896,723 explains in considerable detail the fabrication of a variety of wooden structural units made from this product. In the procedures disclosed in patent '723 harvested logs are used in their harvested condition and lengths. This incurs some wastage because, since the trees are tapered and the product is not, the material removed in eliminating the taper is wasted.

The simultaneous increasing need for wood and decreasing supply make it important to further increase the efficiency of producing, from smaller diameter trees, the wood products described above by decreasing wastage and further improving the quality of the end products. Accordingly, the objective of the subject invention is to provide a method for more efficient use of smaller diameter trees, decreasing wastage and further improving quality of the end products.

SUMMARY OF THE INVENTION

The subject invention is a method for more efficient use of smaller diameter trees, i.e. trees having diameters in a range of 3 inches to 12 inches, some of the uses being based on techniques disclosed in U.S. Pat. No. 5,896,723. Wastage is reduced and product quality is improved by the subject method.

In executing the method described below, fallen trees are cut into segments and the cuts are made at points at which the diameters of the tree are suitable to production, with minimal wastage, of wooden structural units which have specific cross sectional dimensions and similar grain patterns and structure; i.e. similar cross sectional conditions. For purposes of this disclosure these points are called cutting points.

Starting with felled trees, the basic method comprises the steps of:

1. Cutting felled trees at cutting points into a plurality of segments which, naturally, are tapered, each segment having a length, a larger diameter end and a smaller diameter end, the length being in a range of random lengths such that the larger end diameter is in a range of 0.2 to 2.0 inches larger than the smaller end diameter, with 0.2 inch preferred;
2. selecting, from the plurality of segments cut from one or more trees, a plurality of groups of segments which have smaller end diameters different in a range of 0.0 to 2.0 inches with 0.0 preferred;
3. joining segments from each group end-to-end to form reconstituted logs of optimum lengths for processing into wooden structural units;

A first modification of the basic method comprises the steps of:

1. Cutting felled trees transversely to remove defective portions such as knots, split portions and warped portions;
2. cutting the remaining portions at cutting points into segments which are, naturally, tapered, each segment having a length, a larger diameter end and a smaller diameter end, the length being in a range of random lengths such that the larger diameter end is in a range of 0.2 to 2.0 inches larger than the smaller diameter end;
3. selecting, from the plurality of segments cut from the remaining portion of one or more trees, a plurality of groups of segments which have smaller end diameters different in a range of 0.0 to 2.0 inches with 0.0 preferred;
4. joining segments from each group end-to-end to form reconstituted logs of optimum lengths for processing into wooden structural units.

A second modification of the basic method comprises the steps of:

1. Cutting felled trees at cutting points into a plurality of segments which, naturally, are tapered, each segment having a length, a larger diameter end and a smaller diameter end, the length being in a range of random lengths such that the larger end diameter is in a range of 0.2 to 2.0 inches larger than the smaller end diameter, with 0.2 inch preferred;
2. processing the segments with processing varying from minimal trimming to cutting lengthwise into a plurality of pieces, each of the pieces having specific cross sectional conditions;
3. selecting, from the plurality of segments and pieces cut from one or more trees, a plurality of groups of segments and pieces which have closely similar cross sectional conditions;
4. joining segments and pieces from each group end-to-end to form wooden structural units.

For purposes of this disclosure the term "minimal trimming" means cutting, from the surfaces of trees and segments, irregularities such as knots and small branch stubs which could interfere with the handling of a tree or segment. Also, the wording "cross sectional condition" refers to the shape, dimensions and grain structure of the cross section of a tree, segment or piece of a segment. Dimensional similarity means dimensions equal to 2.0 inches different.

A third modification of the basic method comprises the steps of:

1. cutting felled trees transversely to remove defective portions such as knots, split portions and warped portions;
2. cutting the remaining portions at cutting points into a plurality of segments which are, naturally, tapered, each segment having a length, a larger diameter end and a smaller diameter end, the length being in a range of random lengths such that the larger diameter end is in a range of 0.2 to 2.0 inches larger than the smaller diameter end;
3. selecting, from the plurality of segments cut from the remaining portions of one or more trees, a plurality of groups of segments which have smaller end diameters different in a range of 0.0 to 2.0 inches with 0.0 preferred;
4. processing the segments with processing varying from minimal trimming to cutting lengthwise into a plurality of pieces, each of the pieces having specific cross sectional conditions;
5. joining segments from each group end-to-end to form wooden structural units.

The subject basic method and its modifications may be practiced with or without kiln drying of the logs. If kiln drying is done, it is preferably done after the trees have been cut into segments. The energy required to kiln dry the segments is significantly less than that required for kiln drying the full trees, thus enhancing the economic viability of the method. The economic viability is further enhanced because (1) the method allows using virtually all of the length of each tree, rather than discarding portions removed to provide logs of specific lengths, and (2) trees purchased with random lengths are less expensive than trees of specified lengths and the subject method allows economical use of trees of unspecified lengths.

Further, the quality of the joining of the segments is high and predictable because of (1) the relative uniformity of the segments being joined and (2) the matching of the grain and growth ring patterns of the ends being joined.

The invention is described in more detail below with reference to the attached drawings.

BRIEF DESCRIPTION OF THE DRAWINGS

FIGS. 1 and 2 are schematic diagrams which illustrate how the subject method reduces waste.

FIG. 3 is a schematic illustration of a felled tree cut into segments having lengths according to the subject invention.

FIG. 3A is a graphical illustration of the relationship of log diameter to wastage.

FIG. 3B illustrates examples of segment processing according to the processing steps in the second and third modifications of the basic method.

FIG. 4 illustrates a reconstituted log with segments having two flat, parallel surfaces.

FIG. 5 illustrates a reconstituted log with segments having four orthogonal flat surfaces.

FIGS. 6, 7, 8, 9 and 10 illustrate processing of reconstituted logs into wooden structural units as taught in U.S. Pat. No. 5,896,723.

DETAILED DESCRIPTION OF THE INVENTION

The subject invention is a method for more efficient use of smaller diameter trees, more efficient in terms of reduced wastage and improved structural quality of the lumber produced. FIGS. 1 and 2 are schematic diagrams which illustrate how the subject method reduces wastage. FIG. 1 illustrates a piece of lumber 10 sawn from a tree 11 with wastage indicated by cross hatching. FIG. 2 illustrates segments of lumber 12, 13 and 14 sawed from a tree 15 in accordance with the subject method, with wastage indicated by cross hatching and wastage saved indicated by double hatching. Although the lengths in these figures are foreshortened, the areas provide accurate comparative representations of wastage and wastage saved. The double hatched "saved wastage" in FIG. 2 is approximately 80% of the wastage indicated in FIG. 1, indicating that in a tree in which the base diameter is about 3 times the tip diameter, the subject method reduces wastage as much as 80%, as an example. In a log having a base diameter twice the tip diameter, the waste saving approaches 70%.

The basic method of the subject invention comprises the steps of:

1. Cutting felled trees at cutting points into pluralities of segments which, naturally, are tapered, each segment having a length, a larger diameter end and a smaller diameter end, the length being in a range of random lengths such that the larger end diameter is in a range of 0.2 to 2.0 inches larger than the smaller end diameter, with 0.2 inch preferred;
2. selecting from the plurality of segments cut from one or more trees, a plurality of groups of segments which have smaller end diameters different in a range of 0.0 to 2.0 inches with 0.0 preferred;
3. joining segments from each group end-to-end to form reconstituted logs of optimum lengths for processing into wooden structural units;

In a first modification of the basic method, defective portions such as knots, split sections and warped sections are removed from the trees to be processed, using transverse cuts and the method comprises the steps of:

1. Cutting felled trees transversely to remove knots, defective portions such as split portions and warped portions;
2. cutting the remaining portions at cutting points into segments which are, naturally, tapered, each segment having a length, a larger diameter end and a smaller diameter end, the length being in a range of random lengths such that the larger diameter end is in a range of 0.2 to 2.0 inches larger than the smaller diameter end;
3. selecting, from the plurality of segments cut from the remaining portions of one or more trees, a plurality of groups of segments which have smaller end diameters different in a range of 0.0 to 2.0 inches with 0.0 preferred;
4. joining segments from each group end-to-end to form reconstituted logs of optimum lengths for processing into wooden structural units.

In a second modification of the basic method, the segments are processed according to diameter and condition, with processing varying from minimal trimming to cutting lengthwise into a plurality of pieces. The method comprises the steps of:

1. Cutting felled trees at cutting points into a plurality of segments which, naturally, are tapered, each segment having a length, a larger diameter end and a smaller diameter end, the length being in a range of random lengths such that the larger end diameter is in a range of 0.2 to 2.0 inches larger than the smaller end diameter, with 0.2 inch preferred;

2. processing the segments with processing varying from minimal trimming to cutting lengthwise into a plurality of pieces, each of the pieces having specific cross sectional conditions;
3. selecting, from the plurality of segments and pieces cut from one or more trees, a plurality of groups of segments and pieces which have closely similar cross sectional conditions;
4. joining segments from each group end-to-end to form wooden structural units.

In a third modification of the basic method the trees are processed to remove defects and the segments are processed according to size and conditions, the processing varying from minimal trimming to cutting lengthwise into a plurality of pieces. The method comprises the steps of:

1. Cutting felled trees transversely to remove knots, split portions and warped portions;
2. cutting the remaining portions at cutting points into segments which are, naturally, tapered, each segment having a length, a larger diameter end and a smaller diameter end, the length being in a range of random lengths such that the larger diameter end is in a range of 0.2 to 2.0 inches larger than the smaller diameter end;
3. selecting, from the plurality of segments cut from the remaining portion of one or more trees, a plurality of groups of segments which have smaller end diameters different in a range of 0.0 to 2.0 inches with 0.0 preferred;
4. processing the segments with processing varying from minimal trimming to cutting lengthwise into a plurality of pieces, each of the segments and pieces having specific cross sectional conditions;
5. joining segments and pieces from each group end-to-end to form wooden structural units.

The basic method and its modifications can be practiced with or without kiln drying. Kiln drying is preferably done before segments are joined because kiln drying short lengths requires much less energy than drying full-length logs and trees.

FIG. 3 is a schematic illustration of a portion of a felled tree 10' cut into segments having lengths according to the subject method. Segment 16 has a diameter of 1.5 inches at its smaller end and a length of one foot. The smaller end diameters and lengths of segments 17, 18 and 19 respectively are 2½ inches and 1.5 feet, 3½ inches and 2 feet and 4½ inches and 3 feet (full length not shown).

FIG. 3A graphically illustrates the importance of cutting the segments to lengths which minimize the difference between the diameters at the ends of the segments. In order to practice the procedures disclosed in U.S. Pat. No. 5,896,723 the logs must have flat parallel surfaces with widths at least 50% of the diameter of the log. This surface width is achieved when the diameter of the log at a cutting point is 1.14 times the distance D between the surfaces. If the diameter of a log were uniform and it were processed to have two sets of parallel surfaces with widths equal to half the diameter, the wastage produced by cutting to provide the flat surfaces is 13.6% of the log. If the diameter of the log is 1.2 times distance D, the wastage is 21% of the log. If the diameter is 1.4 times distance D, the processed log is square and wastage is 37%. If distance D equals the diameter there are no flat, parallel surfaces and no wastage. These facts are graphically presented in FIG. 3A. It is most interesting that curve X is a straight line. The conclusion to be drawn from this data is that there is significantly more waste in segments with a significantly larger diameter at one end than at the other. Alternately having the end diameters of a segment close, such as no more than ½ inch different, significantly reduces waste.

FIG. 3B illustrates examples of segment processing according to the processing steps in the second and third modifications of the basic method. Each view in FIG. 3B is a schematic diagram of a tree segment cross section with cuts lengthwise of the segments indicated by dashed lines. Reconstituted logs made with minimally processed segments may also be processed in many ways, the views of FIG. 3B being examples. In view (1) the log or segment 20 is sawed to yield a plurality of boards, board 21 being typical and two pieces 22 and 23, termed wanes, which can be further processed into high quality useful wooden structural elements as shown in FIGS. 6–10 discussed below. In view (2) the segment 24 yields a plurality of boards, board 25 being typical, and wanes 26 and 27 by saw cuts, saw cut 24 being typical. In view (3) the segment 27 yields two wanes 28 and 29 which can be processed as shown in FIGS. 6–10. In view (4) the segment 30 has been processed to have four flat, orthogonal surfaces as shown in FIG. 5, surface 31 being typical. In view (5) segment 32 has been cut into halves 33 and 34 which can be further processed as segments or as part of a reconstituted half log.

FIG. 4 illustrates a reconstituted log 35 with segments having been processed to have two flat, parallel surfaces. Segments 36, 37, 38 and 39 are joined, using finger joints 40, 41 and 42, with their flat, parallel surfaces aligned, surfaces 43 and 44 being typical.

FIG. 5 illustrates a reconstituted log 45 with segments having been processed to have four orthogonal, flat surfaces, surface 46 being typical. Segments 47, 48, 49 and 50 are joined, using finger joints 51, 52 and 53 with their flat surfaces aligned, surfaces 54, 55 and 56 being typical.

FIGS. 6, 7, 8, 9 and 10 illustrate, for completeness of this disclosure, examples of processing of reconstituted logs into wooden structural units as taught in U.S. Pat. No. 5,896,723. FIG. 6 illustrates a structural unit 57 made by s half lengthwise as shown by the dashed line in FIG. 5. In FIG. 6 halves 58 and 59 have been joined adhesively with their originally outside surfaces 60 and 61 against each other and faces 62 and 63, previously inner faces, facing outward.

FIG. 7 illustrates two structural units 64 and 65 made by sawing structural unit 57 in half lengthwise at a saw-cut, indicated by the dashed line in FIG. 6. The cut is perpendicular to faces 62 and 63. Units 64 and 65 have 3 flat faces, faces 66, 67 and 68 being typical, at right angles to each other with fourth faces 69 and 70 notched along their longitudinal centerlines, notch 71 being typical.

FIG. 8 is an end view of structural unit 57 cut into three structural units 72, 73 and 74 by saw cuts 75 and 76. FIG. 9 is similar but shows unit 57 cut into four structural units 77,78, 79 and 80 by saw cuts 81, 82 and 83.

FIG. 10 illustrates assembly of units similar to units 64 and 65 into longer and larger unit 84. Units 85, 86, 87 and 88 are joined side-to-side. Hollow portions 89 and 90 lighten the weight of the unit and have no significant effect on its stiffness and strength because they are at the neutral axes of units 85 and 86 and units 87 and 88 respectively.

It is considered to be understandable from this description that the subject invention meets its objectives. It provides a method for more efficient use of smaller diameter trees by decreasing wastage and improving quality of the end products beyond the quality made possible by the teaching of U.S. Pat. No. 5,896,723. The wastage is reduced by reconstituting logs. The quality is improved by removal of defective portions from the logs which are reconstituted and by making the reconstituted logs by end-to-end joining of segments having highly similar grain and growth ring configurations.

It is also considered to be understood that while certain methods are disclosed herein, other methods and modifications of those described are possible within the scope of the invention which is limited only by the attached claims.

I claim:

1. A method for more efficient use of smaller diameter trees, each of said trees being tapered and having a length and diameters in a range of diameters, said diameters varying along said length, said method comprising the steps of:

a. cutting said felled trees into pluralities of segments which are tapered, each segment having a length, a larger diameter end having a larger diameter and a smaller diameter end having a smaller diameter, said length being in a range of lengths and being such that said larger diameter is in a range of 0.2 to 2.0 inches larger than said smaller diameter;

b. selecting, from said pluralities of segments, a plurality of groups of segments which have said smaller end diameters different in a range of 0.0 to 2.0 inches with 0.0 preferred;

c. joining said segments from each of said groups end-to-end to form reconstituted logs.

2. A method for more efficient use of smaller diameter trees, each of said trees having a length and diameters in a range of diameters, said diameters varying along said length, said trees having defective portions, said method comprising the steps of:

a. cutting said trees transversely to remove said defective portions and leaving remaining portions;

b. cutting said remaining portions into pluralities of segments which are tapered, each segment having a length, a larger diameter end having a larger diameter and a smaller diameter end having a smaller diameter, said length being in a range of lengths and being such that said larger diameter is in a range of 0.2 to 2.0 inches larger than said smaller diameter;

c. selecting from said pluralities of segments a plurality of groups of segments which have said smaller end diameters different in a range of 0.0 to 2.0 inches with 0.0 preferred;

d. joining said segments from each of said groups end-to-end to form reconstituted logs.

3. A method for more efficient use of smaller diameter trees, each of said trees having a length and diameter in a range of diameters, said diameters varying along said length, said method comprising the steps of:

a. cutting said felled trees into pluralities of segments which are tapered, each segment having a length, a larger diameter end having a larger diameter and a smaller diameter end having a smaller diameter, said length being in a range of lengths and being such that said larger diameter is in a range of 0.2 to 2.0 inches larger than said smaller diameter;

b. selecting from said pluralities of segments a plurality of groups of segments which have said smaller end diameters different in a range of 0.0 to 2.0 with 0.0 preferred;

c. processing each of said segments in said groups of segments with processing varying from minimal trimming to cutting lengthwise into a plurality of pieces, each of said pieces having specific cross sectional conditions;

d. joining said segments and said pieces having said similar cross sectional conditions from each of said groups end-to-end to form wooden structural units.

4. A method for more efficient use of smaller diameter trees, each of said trees being tapered and having a length and diameters in a range of diameters, said diameters varying along said length, said trees having defective portions, said method comprising the steps of:

a. cutting said trees transversely to remove said defective portions, leaving remaining portions;

b. cutting said remaining portions into pluralities of segments which are tapered, each segment having a length, a larger diameter end having a larger diameter and a smaller diameter end having a smaller diameter, said length being in a range of lengths and being such that said larger diameter is in a range of 0.2 to 2.0 inches larger than said smaller diameter;

c. selecting, from said plurality of segments cut from said remaining portions of one or more trees, a plurality of groups of said segments which have said smaller end diameters different in a range of 0.0 to 2.0 inches with 0.0 preferred;

d. processing each of said segments in said plurality of groups of said segments with processing varying from minimal trimming to cutting lengthwise into a plurality of pieces, each of said pieces having specific cross sectional conditions;

e. joining said segments and said pieces having similar cross sectional conditions from each of said groups end-to-end to form wooden structural units.

* * * * *